United States Patent [19]

Jewitt et al.

[11] Patent Number: 4,789,076

[45] Date of Patent: Dec. 6, 1988

[54] HEAD SEAM FOR A PAIL

[75] Inventors: Joseph H. Jewitt, Stanley; Jack Harley, Coventry, both of United Kingdom

[73] Assignee: International Paint PLC, England

[21] Appl. No.: 38,004

[22] Filed: Apr. 14, 1987

[30] Foreign Application Priority Data

Apr. 17, 1986 [GB] United Kingdom ..... 8609458

[51] Int. Cl.[4] ..... B65D 41/10; B65D 41/12

[52] U.S. Cl. ..... 220/309; 220/74

[58] Field of Search ..... 220/74, 355, 309

[56] References Cited

U.S. PATENT DOCUMENTS 4,513,872 4/1985 Bull ..... 220/74

*Primary Examiner*—George T. Hall

*Attorney, Agent, or Firm*—Davis Hoxie Faithfull & Hapgood

[57] ABSTRACT

The rim of a pail body is provided with a compound curl for reception of a lid. The compound curl comprises an upper region extending away from the wall of the pail body on its outside, a lower region extending from the outer periphery of the said upper region towards the wall of the pail body and a rim edge part which extends from the inner periphery of the said lower region away from the wall of the pail body and is intermediate the said upper and lower regions whereby a lid applied over the rim with the central part thereof located within said rim can be clamped onto the said compound curl to form a seam therewith. The said lower region and the said rim edge part constitute a smaller pre-curl within the compound curl, the rim edge being spaced below the said upper region so that in clamping on the lid, a region of the said rim edge part is brought into supporting engagement with the said upper region. Desirably the wall has three spaced-apart circumferential beads formed therein, the bead closest to the compound curl being shallower than a closely spaced pair of larger beads.

5 Claims, 6 Drawing Sheets

HEAD SEAM FOR A PAIL

TECHNICAL FIELD

This invention relates to a head seam for a pail for the storage and transportation of materials and which is especially useful in the transportation of dangerous goods such as paint. The word "pail" is used in this specification to indicate a cylindrical container closable at one end with a removable lid. Sometimes such a container is called a "drum" although the latter term is more often used to indicate a container having irremovable end closures one of which at least is normally formed with a small opening for filling and/or emptying the container.

DISCUSSION OF PRIOR ART

It is important in transporting materials which are corrosive or flammable that secure packages are used which are not readily susceptible to damage and leakage, for example if they are dropped during loading and unloading. Specifications for packaging have been raised over the years and it can be expected that they will be raised further.

The present invention seeks to provide a head seam for fastening the lid of a pail to the body which is more secure than that at present in use on conventional pails.

Conventionally, a head seam for a pail is a five fold double seam. To form such a seam a curl is formed around the outside of the upper rim of the pail and a channel is formed around the periphery of the lid with downwardly directed flanges located at intervals around the lid. A sealing compound is run into the channel on the lid and the lid is clamped onto the curl on the pail by means of a clamping tool applied to the flanges, thus squeezing the channel onto the curl around the periphery of the pail to create a seal.

The present invention provides an improved seam compared with this conventional five fold seam.

SUMMARY OF THE INVENTION

According to one aspect of the invention there is provided a pail body having a rim provided with a compound curl for reception of a lid and comprising an upper region extending away from the wall of the pail body on its outside, a lower region extending from the outer periphery of the said upper region towards the said wall, and a rim edge part which extends from the inner periphery of the said lower region away from the said wall and is intermediate the said upper and lower regions whereby a lid can be inserted in the said rim of the pail body and clamped onto the said compound curl to form a seam therewith.

It is advantageous to form the pail body with three circumferential beads in the region of the said curled rim, the three beads comprising a single comparatively shallow bead comparatively close to the said rim with a compound curl and a pair of closely spaced comparatively large beads at a comparatively large distance from the said rim with a compound curl.

According to a further aspect of the invention, a method of manufacturing a metal pail body having a wall terminating in a curled rim to receive a lid, includes a procedure for making the curled rim which comprises the steps of:

(a) forming a pre-curl on the wall having an upper region extending outwardly from the outside of the said wall and a rim edge part extending towards the said wall, (b) expanding the pail body so that it tapers to become narrower in the direction away from the said pre-curl, thereby reducing the cross-sectional diameter of the pre-curl and bringing the said rim edge part closer to the said wall, and (c) performing another curling operation on the said pre-curl to produce a compound curl in which the said rim edge part extends away from the said wall and is intermediate an upper region of the compound curl and a lower region of the compound curl.

The invention also includes a method of manufacturing a pail by fitting a lid to the compound curl rim of a pail body made as described above and also includes a pail including a lid so fitted.

A further aspect of the invention is a rim-forming line for the manufacture of pail bodies comprising stations for carrying out the following operations:

(a) an operation for forming a pre-curl on a rim of the pail body having an upper region extending outwardly from the outside of the said wall and a rim edge part extending towards the said wall, (b) an operation for expanding the pail body so that it tapers to become narrower in the direction away from the said pre-curl thereby reducing the cross-sectional diameter of the pre-curl and bringing the said rim edge part closer to the said wall, and (c) an operation for carrying out another curling operation on the pre-curl to produce a compound curl in which the said rim part extends away from the said wall and is intermediate the upper region of the compound curl and a lower region of the compound curl.

The rim-forming line can also include one or more stations to form three circumferential beads in the wall of the pail body in the region of the curled rim and comprising a comparatively shallow bead comparatively close to the said curled rim and a pair of closely spaced comparatively large beads at a comparatively large distance from said curved rim.

Another aspect of the invention is a closing tool for applying a lid to a pail body, the closing tool including a downward extension dimensioned to contact a central region of the lid when the closing tool is in use, and also including a central pillar on which are pivoted levers connected by linkages to a spider having a central mounting slidable on the pillar and wherein brackets carried on the mounting pivotally carry arms each connected to an associated closure element pivoted on a base which carries the central pillar and the said downward extension. Preferably, a lid to be applied by the closing tool has at least one annular corrugation outwardly of the said central region in a configuration such that when the said downward extension of the closing tool applies pressure to the said central region of the lid during the closing operation, the material of the lid is urged outwardly at the rim of the pail body.

The invention also extends to a method of applying a lid to a pail body wherein the lid has a channel which accommodates a curl around the rim of the pail body and has flanges which are to be clamped beneath the said curl against the wall of the pail body and wherein pressure is applied in a central region of the lid as the flanges are clamped home.

BRIEF DESCRIPTION OF THE DRAWINGS

The invention will be further described, by way of example, with reference to the accompanying drawings in which.

DESCRIPTION OF PREFERRED EMBODIMENTS

Figure 1:
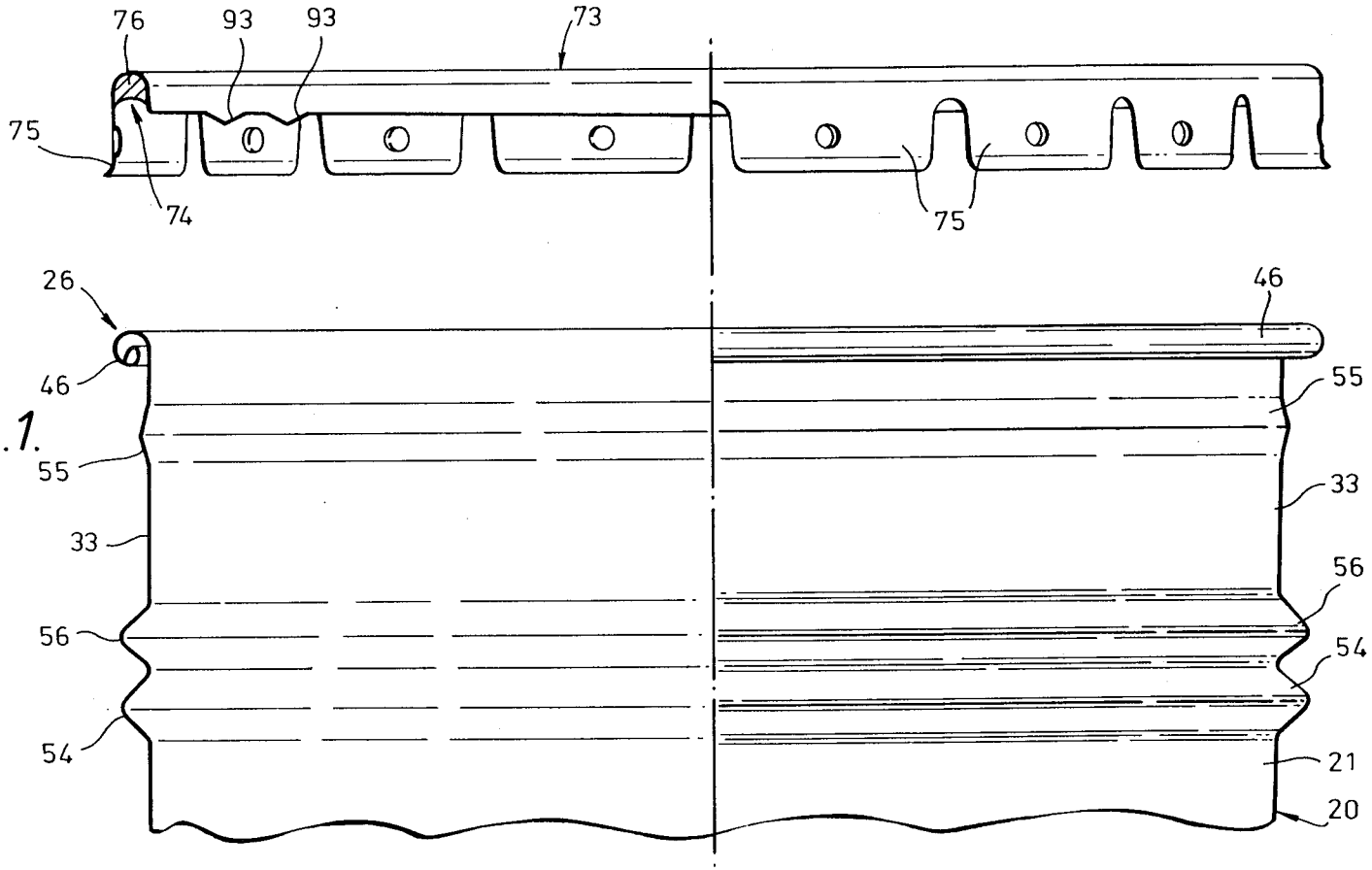
FIG. 1 is a half section through a pail according to the invention showing a lid in a position above the pail body ready for fitting thereto, the left-hand half being in section and the right-hand half being in side elevation.

The pail 20 shown in part in FIG. 1 has a capacity of 20 liters and its body 21 is made from 27 gauge (0.43 mm thick) mild steel.

The first stage in the manufacture of the pail body 21, in the present case, is a conventional procedure involving rolling to form a cylinder and crush welding to produce a longitudinal seam. Other welding techniques may be used to form this longitudinal seam.

The pail body 21 is then transferred to a rim-forming line (see FIG. 12) which is conventional in respect of the means for transporting the pail bodies and, in general terms, in respect of the means for forming them, but is novel in that it comprises stations for carrying out the following operations:

(a) a pre-curling operation (at station E),
(b) an expansion of the pail body (at station F),
(c) a second curling operation together with formation of a bead in the pail body, (at station G), and
(d) formation of two more beads in the pail body (at station H)

Figure 2:
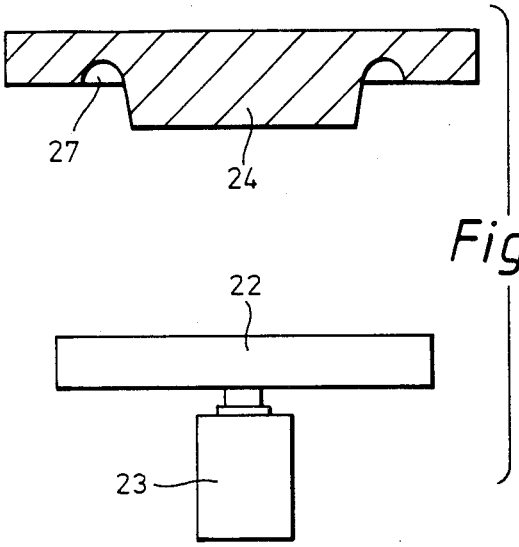
FIG. 2 is a schematic representation of a tool for forming a curl on an upper rim of a pail body and constituting part of a rim-forming line according to the invention.
Figure 12:
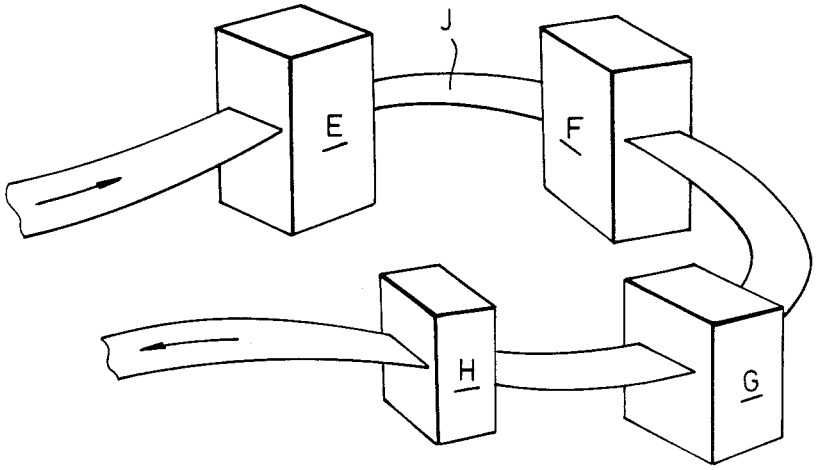
FIG. 12 is a schematic representation of a rim-forming line in accordance with the invention for the manufacture of pail bodies.

The conventional transporting means for the pail bodies in a rim-forming line according to the invention are shown only schematically at J in FIG. 12 and can be of any convenient design. The pre-curling tool of station E is shown in FIG. 2. The pre-curling tool comprises, in the present case, a table 22 mounted on a hydraulic ram 23 below a tool head 24 (alternatively a mechanically-operated tool may be used). The cylindrical pail body 21 is delivered by the transporting means (not shown) to the table 22 so that its lower rim (not shown) stands on the table 22. The upper rim 26 is located below the groove 27 in the tool head 24. At this stage the upper rim 26 extends straight up and is undeformed. The hydraulic ram 23 then raises the table 22 pushing the rim edge part 28 (FIG. 5) of the rim 26 of the pail body 21 into the groove 27 and causing it to curl round beneath an upper region 29 of the pre-curl 30 shown in FIG. 5 and to extend towards a pail wall 33. This pre-curling operation is conventional per se in that it is similar, in principle, to curling operations carried out in producing the known five-fold seam but the use of a pre-curling operation is not conventional. The pre-curl 30, in the present instance has a diameter in the vertical direction (dimension A in FIG. 5) of 4.5 mm.

Figure 3:
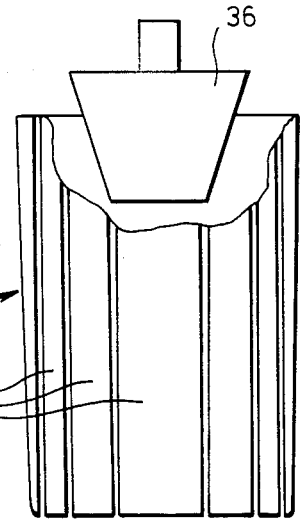
FIG. 3 is a schematic representation of a tool for expanding the body of a pail also constituting part of the rim-forming line referred to above.
Figure 4:
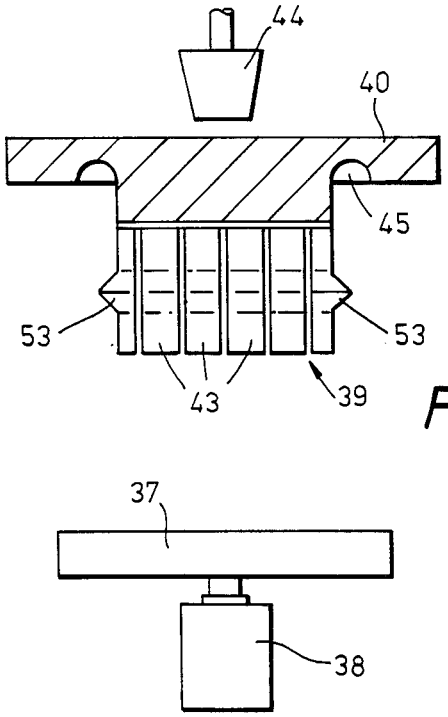
FIG. 4 is a schematic representation of a tool for simultaneously further curling the upper rim of a pail body and forming a bead in the body of a pail, this tool also constituting part of the rim-forming line referred to above.
Figure 5:
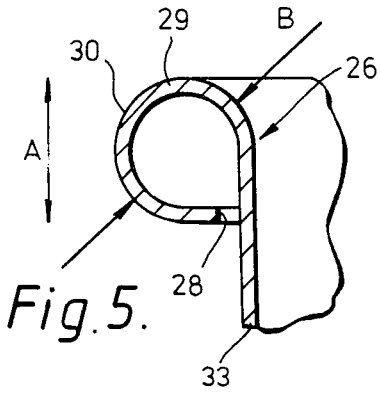
FIG. 5 is a section through the upper rim of a pail body after subjection to a pre-curl operation.
Figure 6:
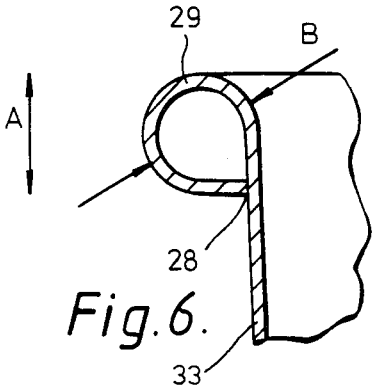
FIG. 6 is a section through the upper rim of the pail body shown in FIG. 5 after the pail body has been subjected to an expanding operation.

After the pre-curling operation illustrated in FIG. 5, the pail body 21 is transported to an expanding tool making up station F of the rim-forming line shown schematically in FIG. 12. The expanding tool is shown at 34 in FIG. 3 and is per se conventional. It operates by means of a set of fingers 35 which are inserted in the pail body 21 and which are mounted so that they can be splayed outwards at the top by introduction between them of a conical wedge 36 under the influence of a hydraulic ram (not shown). In the present instance, the expanding tool 34 imparts to the pail body 21 the shape of the frustum of a cone having a diameter of 270 mm at the bottom and 280 mm at the top, that is, the pail body is expanded so that it tapers to become narrower in the direction away from the rim 26 and pre-curl 30. The effect of this deformation of the pail body is to reduce the dimension A of the pre-curl 30 to 4.0 mm and bring the rim edge part 28 close to or even in contact with the pail wall 33. This condition of the pre-curl 30 is shown in FIG. 6. FIGS. 5 and 6 also illustrate the reduction of an oblique diameter B of the pre-curl 30 from 4.5 mm in FIG. 5 to 4.0 mm in FIG. 6.

The next station G on the rim-forming line is shown in FIG. 4. This station operates on the pail wall 33 as well as on the rim 26 of the pail body. A table 37 to support the pail body 21 is mounted on a hydraulic ram 38 beneath a bead-forming tool 39 and a tool head 40. The bead-forming tool is per se conventional and comprises segments 43 mounted so that they can be moved apart by introduction between them of a conical wedge 44 carried by a hydraulic ram (not shown).

Figure 7:
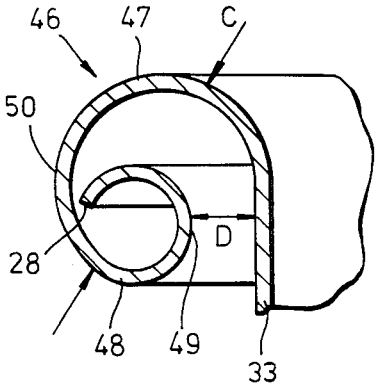
FIG. 7 is a section through the upper rim of the pail body shown in FIG. 5 after subjection to a second curling operation.

A pail body having a pre-curl 30 and transported to the table 37 is raised by upward movement of the table 37 under the influence of the hydraulic ram 38 pressing the pre-curl 30 into a groove 45 in the tool head 40. This operation produces a compound curl 46 by curling the already pre-curled pail rim 26. The result is shown in FIG. 7 where the rim edge part 28 is shown extending away from the pail wall 33 and is located intermediate an upper region 47 of the compound curl 46 extending 48 of the compound curl extending from the outer periphery of the upper region 47 towards the pail wall. The rim edge part 28 extends from the inner periphery of the said lower region 48 away from the pail wall 33. The lower region 48 at least partly comprises the upper region 29 of the pre-curl 30 (FIGS. 5 and 6). The diameter C of the compound curl 46 is, in the present instance, 7.5 mm and an inner part 49 of the compound curl is spaced from the pail wall 33 by a distance (D) of 2.1 mm. The rim edge 28 is still located close to or in contact with the inner surface of the compound curl near an outer part 50 of the compound curl which is furthest from the pail wall 33.

After formation of the compound curl 46 and while the pail body is still in station G, the bead-forming tool 39 is operated by the conical wedge 44 which moves the segments 43 outwards so that ridges 53, one of which is formed on each segment, are pressed into the pail wall 33 thus forming in it a lower bead 54 (FIG. 1).

The pail body is next transported to a further work station H at which a second bead forming tool (not shown) having two series of bead-forming ridges similar to the ridges 53 is operated to form an upper bead 55 (FIG. 1) and a middle bead 56.

In the present instance, the highest point of the upper bead 55 (in relation to the pail wall 33) is located 25 mm below the upper region 47 of the compound curl 46 and has a height from the pail wall 33 of 1.5 mm. The distance from the upper region 47 to the centre of the valley between the middle bead 56 and the lower bead 54 is 85 mm. The lower bead 54 has a height of 7.5 mm and the middle bead 56 has a height of 7.0 mm. The bead arrangement is thus a pair of comparatively large closely spaced beads at a comparatively large distance from the compound curl 46 at the upper rim of the pail body and a relatively shallow bead comparatively close to the compound curl.

The beads play a part in protecting the head seam of the present pail if the pail is dropped, as will be described below, and their position and size are important factors in achieving such protection. The upper bead 55 is preferably located no less than 20 mm and no more than 35 mm from the upper region 47 and preferably has a height from the pail wall 33 of from 1 mm to 3 mm. The high points of the middle and lower beads are located, on the pail body shown in FIG. 1, 77 mm and 94 mm respectively from the upper region 47 and the spacing apart of these beads is thus 17 mm. This spacing is preferably from 12 mm to 20 mm. The centre of the valley between the middle and lower beads is preferably located from 80 mm to 90 mm from the upper region 47.

To complete the pail body ready for the reception of a lid, the bottom of the pail must be secured to the lower rim of the pail wall. This may be carried out on the same forming line as used to produce the compound curl at the upper rim 26 of the pail body and is preferably done in such a way as to produce a bottom seam of a similar standard to the head seam which, as will be described below, can be produced using the compound curl described above.

Fitting of the lid 73 to complete the pail 20 is carried out after filling the pail. As shown in FIG. 1, the lid 73 has a channel 74 formed around its periphery and at regular intervals, closely spaced, around the lid are downwardly directed flanges 75. The channel 74 is partly filled with a sealing compound 76 (preferably a synthetic rubber) which is run into the channel (with the lid inverted) in liquid state and caused or allowed to solidify to a degree such that it can still flow under pressure to form a seal. Preferably, the meniscus of the sealing compound 76 in the channel 74 is concave producing a more even distribution of the sealing compound in the head seam than would otherwise be the case. This can be achieved either by choice of a sealing compound with a suitable surface tension in relation to the metal of the lid 73 or by deforming the surface of the sealing compound at a suitable stage during its solidification.

Figure 8:
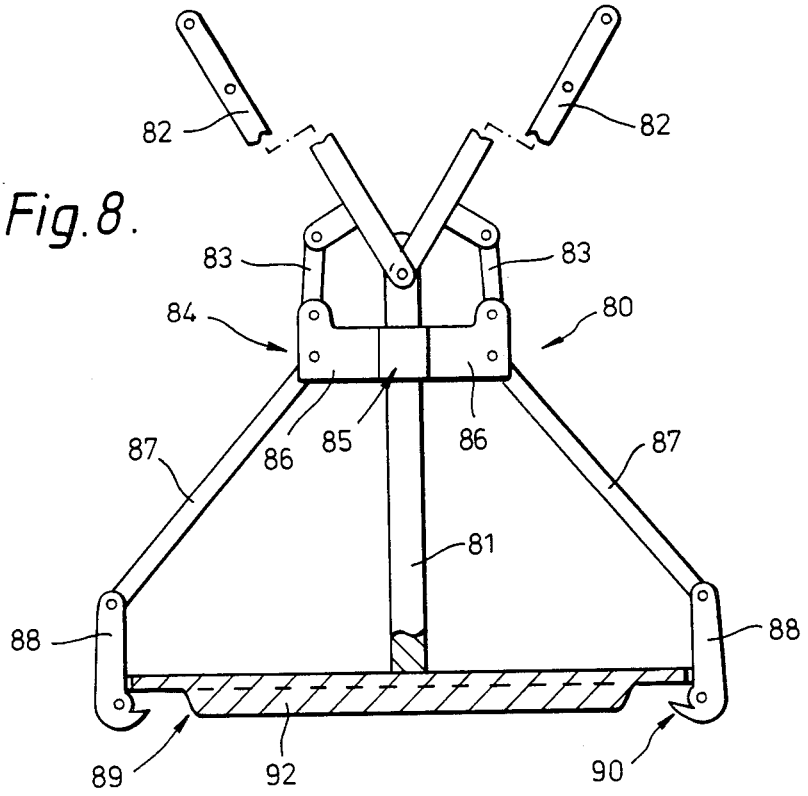
FIG. 8 is a partial cross-section through a closing tool for applying a lid to the pail body of FIGS. 1 to 5.
Figure 9:
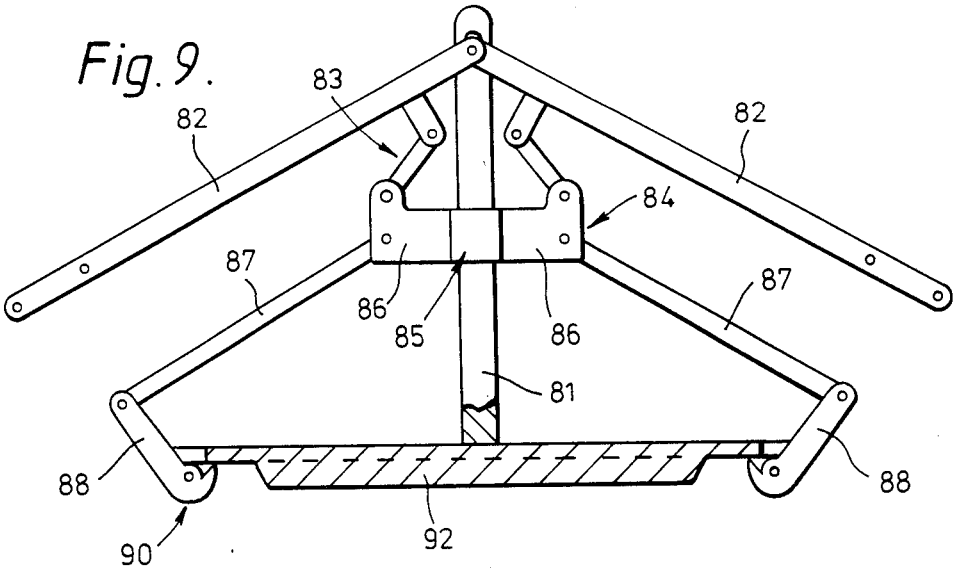
FIG. 9 is a view corresponding to FIG. 8 showing the closing tool in the closed-up configuration.

To apply the lid 73 to the pail body 21, the lid is placed on the upper rim 26 of the pail body 21 so that the compound curl 46 is located in the channel 74. A closing tool 80 as shown in FIGS. 8 and 9 is then used to clamp the lid 73 onto the pail body 21 and thus complete the head seam between the pail body 21 and the lid 73.

The closing tool 80 comprises a central pillar 81 on which are pivoted two levers 82 connected by linkages 83 to a spider 84 having a central collar 85 slidable on the pillar 81. Extending radially outwardly from the collar 85 at closely spaced intervals are brackets 86. Only two brackets 86 are shown in FIGS. 8 and 9 and the linkages 83 are connected to these but each bracket 86 has pivotally secured to it an arm 87 and each arm 87 is pivotally connected to an associated closure element 88. Each closure element 88 is pivotally mounted on a lug (not visible in FIGS. 8 and 9) on a circular base 89 which carries the pillar 81.

Figure 11:
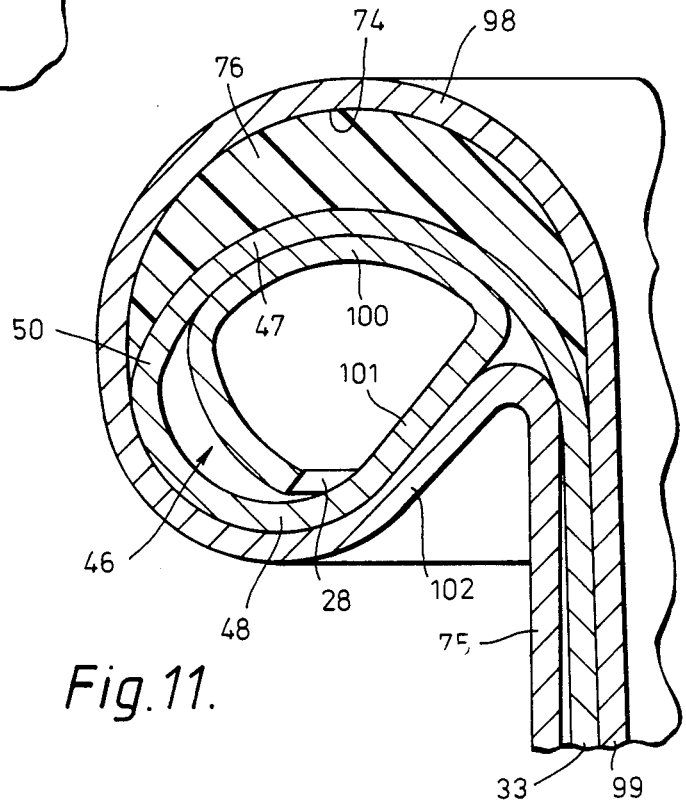
FIG. 11 is an enlarged section through a completed head seam according to the invention.

In using the closing tool 80, the operator places the tool centrally on the lid 73 already located on the pail body 21 so that each of the closure elements 88 is opposite a respective one of the flanges 75. The operator then presses down on the levers 82 moving the spider 84 downwardly on the pillar 81 and causing hooked ends 90 of the closure elements 88 to engage the flanges 75 as shown in FIG. 10 (which shows the compound curl 46 partly deformed) thus deforming them around the compound curl 46 and forming a head seam as shown in FIG. 11.

Figure 10:
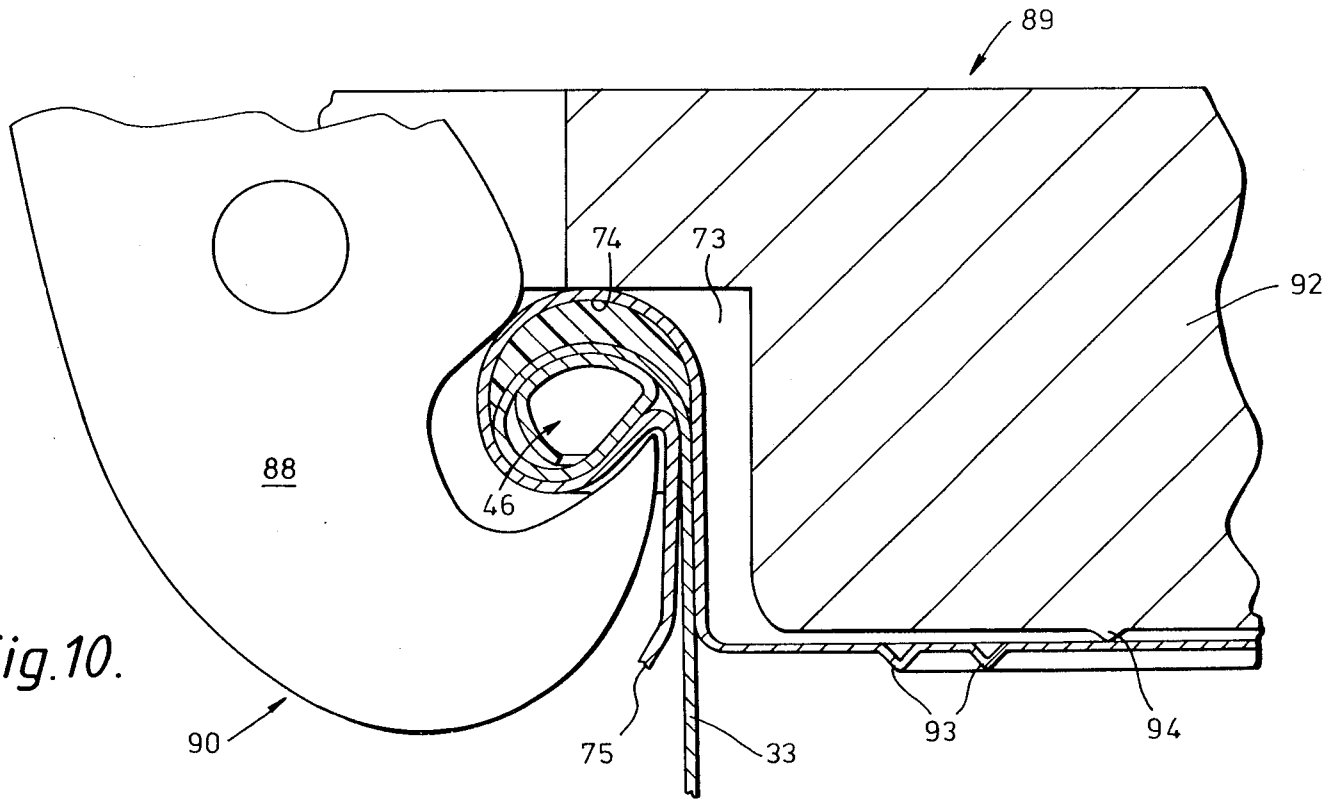
FIG. 10 shows part of the closing tool similar to that of FIGS. 8 and 9 when the tool is in the closed-up configuration and is applied to a pail body and lid, in use.

The closing tool 80 is similar to previous closing tools but differs in that its base 89 is formed with a downward extension 92 which is dimensioned to contact the lid 73 when the tool is in use (see FIG. 10). The lid 73 is formed with two annular corrugations 93 and the contact between the lid 73 and the extension 92 takes place in a central region of the lid inwardly of the corrugations 93 and in this instance between the lid and an annular bead 94 on the extension 92. The base 89 of the closing tool 80 is different from that of a conventional closing tool for head seams in this respect in that the base of the conventional tool does not have a downward extension such as the extension 92 and the peripheral region of the base contacts the bottom part of the channel 74. The action of the closing tool 80 in forming the head seam thus differs from the conventional closing action and the presence of the corrugations 93 in the lid 73 assist in this action, in that when the annular bead 94 on the base 89 presses down the centre part of the lid, an outward movement of the metal of the lid is produced in the region of the upper rim 26 of the pail body 21. This has the effect of pushing extra metal into the head seam which assists in the formation of a tighter, more resilient seam less susceptible to opening up on impart if the pail is dropped. The outward movement may be explained by the downward pressure of the closing tool 80 on a central region of the lid 73 producing a tendency at least for the inner corrugation, with a downwardly directed depression 93, to to straighten out and occupy a greater horizontal distance.

It is believed that a single corrugation 93 in the lid 73 will assist in this action but it is preferred to have two corrugations to obtain the desired effect. Three corrugations may be desirable in some cases.

A head seam made as set out in the example described above will satisfy drop tests and pressure tests when filled with liquid which are superior to those survivable by conventional five fold seams.

It is usual to weld to the pail body at some stage during manufacture a pair of ears for reception of a wire handle. In the example described above, the ears may be located between the upper (55) and middle (56) beads.

The three beads in the pail wall described in the above example of the invention serve, if the pail is dropped, to provide regions where distortion of the pail wall can occur, reducing the degree of distortion of the head seam so that the head seam is less likely to leak. If the pail drops on its side, the beads partly collapse accommodating the handle of the pail which is thus less likely to puncture the pail wall. The lower bead 54 serves as a nesting device when one pail is inserted in another and also absorbs surge pressures created in liquid in the pail when the pail is dropped on its side, thus reducing the risk of these pressures affecting the head seam. When the pail is dropped onto its lid, the upper bead allows the pail wall to deform outwardly, permitting the lid to move down into the pail body, thus protecting the head seam. The outward deformation, or bulge, of the pail body at the upper bead usually presses against the head seam and assists in holding the lid in position.

In the head seam in the example of the invention, described above, the sealing compound 76 (FIG. 11) is spread throughout, or substantially throughout, the space between a base 98 of the channel 74 and the upper region 47 of the compound curl 46. Further, the base 98 follows the general line of the curve of the upper region 47 although at a greater radius and there is general conformity between the deformed channel 74 and flange 75 of the lid and the associated parts of the compound curl 46. In fact the channel 74 and the flange 75 are in close contact with the outer part 50 and lower region 48 of the compound curl and the pail wall 33, lid wall 99 (the inside of the channel 74) and each flange 75 are parallel and close to one another or in contact throughout the whole or substantially the whole of the length of each flange 75. Additionally, the upper region 47 is supported by a region 100 of the pre-curl (originally the lower region of the pre-curl 30) which is in contact with it over a substantial distance. This support which adds to the strength of the compound curl and the tightness (comparatively small cross-wise dimensions) of the compound curl enable the lid to be clamped onto it securely and the compound curl yet retains sufficient resilience to maintain a clamping action on the associated parts of the lid. In particular, an inner region 101 of the lower region 48 of the compound curl is straight and obliquely inclined in FIG. 11 and is urged against an adjacent part 102 of the wall of the channel 74 of the lid thus tending to trap the part 102 and the associated flange 75, which lie at an acute angle, against the pail wall 33. In fact, therefore, as shown in FIG. 11, the inner region 101 of the lower region 48 of the compound curl 46 lies at the same acute angle to the pail body 21 as the angle between the part 102 of the wall of the channel 74 and each flange 75. Further, as also shown in FIG. 11, the rim edge part 28 is further curled by the operation of clamping the lid 73 in place, by crimping home the flanges 75, so that rim edge part 28 extends in a direction downwardly in the Figure and generally towards the pail body 21. Before clamping the lid 73 onto the pail body 21, the smaller pre-curl 30 formed by the lower region 48 and the rim edge part 28, and, as shown in FIG. 7, constituting an inner curl of the compound curl 26 is spaced below, and thus the rim edge part 28 is spaced below, the upper region 47 of the compound curl. In clamping on the lid, the region 100 (FIG. 11) of the rim edge part 28 is brought into supporting engagement with the upper region 47, as described above.

What is claimed is:

1. A pail having a lid closing the pail, the pail having a side wall and a rim, said rim having a compound curl comprising an upper region extending away from the outside of the pail wall, a lower region extending from the outer periphery of the upper region towards the pail wall and a rim edge part intermediate said upper and lower regions and extending from the inner periphery of said lower region away from the pail wall and said lid having a channel and a plurality of downwardly extending flanges on its periphery, the compound curl of the rim of the pail wall being seated in the channel of the lid and the flanges being deformed around the compound curl to maintain the channel in close contact with part of said lower region and with the wall of the pail body, each flange and the adjacent part of the channel lying at an acute angle to one another and between the compound curl and the pail wall.

2. A pail body according to claim 1 having three circumferential beads formed in the wall thereof in the region of the said curled rim, the three beads comprising a single comparatively shallow bead comparatively close to the said rim with a compound curl and a pair of closely spaced comparatively large beads at a comparatively large distance from the said rim with a compound curl.

3. A pail body according to claim 2 wherein the shallow bead is located no less than 20 mm and no more than 35 mm from the said upper region of the compound curl and has a height from the wall of the pail body of from 1 mm to 3 mm.

4. A pail body according to claim 2 wherein the spacing of the high points of the large beads is from 12 mm to 20 mm and the centre of the valley between the large beads is located from 80 mm to 90 mm from the said upper region.

5. A pail body according to claim 3 wherein the spacing of the high points of the large beads is from 12 mm to 20 mm and the centre of the valley between the large beads is located from 80 mm to 90 mm from the said upper region.

* * * * *

UNITED STATES PATENT AND TRADEMARK OFFICE

CERTIFICATE OF CORRECTION

PATENT NO. : 4,789,076

DATED : 12/6/88

INVENTOR(S) : Joseph H. Jewitt et al

It is certified that error appears in the above-identified patent and that said Letters Patent is hereby corrected as shown below:

Column 4, line 60, at the end of the line, insert "away from the pail wall on its outside and a lower region".

Column 6, line 61, delete "to".

Signed and Sealed this

Sixth Day of June, 1989

*Attest:*

*Attesting Officer*

DONALD J. QUIGG

*Commissioner of Patents and Trademarks*